US007384500B2

(12) United States Patent
Lüdtke

(10) Patent No.: US 7,384,500 B2
(45) Date of Patent: Jun. 10, 2008

(54) MANUALLY OPERATED MOISTENER FOR ITEMS WITH A WATER-ACTIVATED GLUE

(75) Inventor: Detlef Lüdtke, Berlin (DE)

(73) Assignee: Francotyp-Postalia GmbH (DE)

( * ) Notice: Subject to any disclaimer, the term of this patent is extended or adjusted under 35 U.S.C. 154(b) by 38 days.

(21) Appl. No.: 11/178,000

(22) Filed: Jul. 8, 2005

(65) Prior Publication Data

US 2006/0011303 A1 Jan. 19, 2006

(30) Foreign Application Priority Data

Jul. 16, 2004 (DE) ..... 20 2004 011 390 U

(51) Int. Cl.

| | |
|---|---|
| ***B43M 3/00*** | (2006.01) |
| ***B43M 5/00*** | (2006.01) |
| ***B05C 1/06*** | (2006.01) |
| ***B05C 1/16*** | (2006.01) |
| *B43M 5/02* | (2006.01) |
| *B05C 11/08* | (2006.01) |

(52) U.S. Cl. ..... 156/442.2; 156/441.5; 156/442.4; 118/256; 118/264; 118/268; 118/270

(58) Field of Classification Search ..... 156/441.5, 156/442.1–442.4; 118/256, 264, 268, 270
See application file for complete search history.

(56) References Cited

U.S. PATENT DOCUMENTS

| | | | | |
|---|---|---|---|---|
| 3,905,325 | A * | 9/1975 | Labore et al. | 118/688 |
| 4,643,123 | A | 2/1987 | Auerbach | |
| 4,767,228 | A | 8/1988 | Harry | |
| 4,903,633 | A | 2/1990 | Nobile et al. | |
| 4,926,787 | A * | 5/1990 | Fassman et al. | 118/32 |
| 5,022,953 | A | 6/1991 | Fassman et al. | |
| 5,209,806 | A | 5/1993 | Hibberd | |
| 5,555,673 | A * | 9/1996 | Smith | 47/1.5 |
| 5,746,881 | A * | 5/1998 | Jenkins et al. | 156/578 |
| 6,322,663 | B1 * | 11/2001 | Muller et al. | 156/441.5 |
| 6,406,591 | B1 | 6/2002 | Beckstrom et al. | |
| 2003/0141019 | A1 * | 7/2003 | Coret et al. | 156/441.5 |

FOREIGN PATENT DOCUMENTS

| | | |
|---|---|---|
| DE | PS 15 11 420 | 4/1976 |
| EP | 0 487 324 | 5/1992 |

* cited by examiner

*Primary Examiner*—Philip C Tucker
*Assistant Examiner*—Sonya Mazumdar
(74) *Attorney, Agent, or Firm*—Schiff Hardin LLP

(57) ABSTRACT

A manually-operated moistener, to which a mail piece is supplied lying flat with a down-turned but not yet adhered flap on the underside of the envelope, has a blade in an upper part and a moistener rocker that can be opened upwardly and can be rotated with at least one locking contour on an associated hinge on the blade so as to be spring-supported as well as locked in a maintenance position. The upper part and a lower part of the moistener are connected by connection elements that can be detached only from above. An antibacterial upper moistening element is disposed in the upper part with a clamping region thereof in a clamping groove of the moistener rocker. A water transfer element protrudes into the lower part, which element is curved at its other, upper end. Both possess a shared contact surface for water transfer that is enlarged by the curvature.

24 Claims, 6 Drawing Sheets

MANUALLY OPERATED MOISTENER FOR ITEMS WITH A WATER-ACTIVATED GLUE

BACKGROUND OF THE INVENTION

1. Field of the Invention

The invention concerns a manually operated moistener of the type suitable for use with a mail processing machine as well as similar billing or mail processing apparatuses to which a postal item is manually supplied. Moisteners are used together with devices for sealing postal goods, in particular letter envelopes with a flap that has a water-activated adhesive edge.

2. Description of the Prior Art

A device for wetting and sealing the flap of a letter envelope supplied lying flat is a known from U.S. Pat. No. 799,304. The letter envelope has a flap on its upper side (in the device) and bears the receiver address on its underside.

A wetting device for letter flaps in connection with franking machines is known from German 15 11 420. A letter envelope supplied flat has a turned-down but not yet adhered lap on its underside. The wetting device has a platform and a sword-shaped blade that can be rotated on a hinge so as to cover the platform, the blade being provided with a wetting strip in the underside thereof facing the platform, in a region that is near the top of the envelope flap when the envelope is in place. The wetting strip penetrates between the envelope body and the flap and moistens the flat when the envelope is advanced. The wetting strip is held by spring tongues, which also press the flap of the envelope being guided through the wetting device against the wetting strip so that the adhesive edge is moistened. This wetting device was used in the 1970s for electrical franking machines of the type CM 7000 commercially available from Francotyp Postalia and in a slightly improved form in the 1980s for electrical franking machines of the type MS 5 Curier and MS 5 WK, as well as in the 1990s for electronic franking machines of the type EFS.

The thermotransfer franking machine T1000, also commercially available from Francotyp Postalia, has a fixed thermotransfer print head in the housing for printing a franking imprint and a bay externally attached to the housing for acceptance of an exchangeable ink ribbon cartridge (U.S. Pat. No. 4,767,228). A manual moistener which is basically formed of a cladding, tank, seal, flap separator blade and moistening rocker can be pre-fixed to the thermotransfer franking machine T1000. The screwing together of the parts ordinarily ensues from below so that the screws are hidden from view. The moistening rocker is provided with a natural felt attached in a mount that presses by means of elastic force against a natural felt arranged below, which is integrated into the cladding and acts as a water transfer means in order to supply the water located in the tank to the upper natural felt.

Since normally the tank will not be completely empty of water, the connection from below complicates the regular cleaning cycle of the tank and can lead to unwanted spillate of the remaining water via the filling opening when the module is tilted to loosen the screws.

The filling opening is hidden, covered and so that evaporation of the water during times of non-usage is reduced, such that the system does not dry out given a longer downtime.

The filling opening is open in comparable devices of other franking machine manufacturers, for example the type DM 300 commercially available from Pitney Bowes, in order to enable easy refilling (U.S. Pat. No. 6,406,591), but the water level is more significantly reduced by evaporation so that the water tank of the device can dry out given longer downtimes of the franking machine.

Actuated letter closers of the EFS and Ultimail® franking machines commercially available from Francotyp Postalia are somewhat complicated and make use of a removable tank and with a ball valve integrated into a sealing cap on the underside of the tank. A letter closing machine of the type V3000 for franking machines of the type EFS has an automatic separating and feed device with a downstream moistening and letter closing device. From a front view, the removable tank lies behind the moistening device and can be extracted from above.

A tank with ball seal also exists in comparable devices by other franking machine manufacturers, for example Pitney Bowes, as described in U.S. Pat. No. 5,209,806. Such a ball seal can reduce evaporation, but makes filling the tank with water more difficult. Such a removable tank with a ball seal is somewhat complex, which makes the manufacture thereof more expensive. This is balanced against the advantage of avoiding drying out of the water reservoir, which leads to time-consuming re-start difficulties of the system after refilling, since dried-out moistening elements and special natural felts can only be wetted again with difficulty and, upon drying out, easily form unhealthy mold and mildew.

To prevent this disadvantage, the upper moistening elements, that are in danger of drying out, in Ultimail or and EFS, and in the manual moistener according to U.S. Pat. No. 6,406,591 (Pitney Bowes), now use brushes instead of felt. Brushes, however, can store less water and are more easily contaminated by the flap adhesive.

The letter-closing machine of the type V3000 for EFS franking machines has a brush with a rear-fed felt serving for water storage in the upper region of the moistener. The felt storage for the most part draws water from the lower tank region from above via a wick, while the flap of the mail item prevents absorption via the lower transfer material. However, this makes the accessibility to the moistener elements more difficult and can easily lead to the unseating of the upper moistener elements on the lower transfer material if the flexible wick prevents a down folding.

Particularly in manual moisteners, the pressure of the upper moistener elements on the lower transfer material or the envelope flap can be reinforced by a spring, which leads to a more secure water transfer and adhesion of the moistened flap to the envelope body. Separate axles are mounted as rotation points for the moistener rocker. There are also simplified arrangements in which these axles are integrated into molded parts (such as the blade and the moistener rocker) with specially formed geometries (U.S. Pat. Nos. 4,926,787 and 4,903,633 and 5,022,953 and letter closers of the type V3000 for the EFS and Ultimail® franking machines).

Particularly with smaller postal apparatuses with lesser metering capacity and lower throughput of mail pieces, longer downtimes frequently occur in which the water reservoir can dry out by evaporation. In this case aggravated, unhealthy mold and mildew formation occurs in many moistening materials. After the devices have been dried out, time-consuming start-up difficulties occur until the necessary moistening capabilities are again available to the system. Some moistening materials are even unusable and must be changed. The water level in the tank often can be detected read only with difficulty, so refilling is easily forgotten. Given a modular design, i.e. a tank that is removable from the franking machine, at the regular cleaning intervals spillage of the residual water content easily occurs during the tilting of the module in order to reach the screw connections accessible from below. As noted above, the water filling opening is covered in the known moistener used in the T1000 franking, but it is accessible only with difficulty since it is hidden, at a central location relative to the flap length, below the rotational axis of the spring-operated moistening rocker. In the predecessor model, the moistener contact surfaces of the upper and lower water transfer means are too narrow to ensure a sufficient wetting of large or long flaps lying transversally in C4 envelope formats.

SUMMARY OF THE INVENTION

An object of the present invention is to provide a manual moistener that is improved with regard to maintenance. A further object is to provide such a manual moistener water fill opening that is covered nut which is easily accessible in an uncomplicated manner while still achieving low evaporation. Another object is to make cleaning of such a manual moistener easier, wherein water spillage is prevented upon loosening the connection of the water reservoir from its normal position. A further object is to design a water transfer and moistening arrangement for such a manual moistener that requires less maintenance and has an easier wetting capability, and that is easily exchangeable and has a sufficient water dispensing quantity to moisten even large, transversally-lying envelope flaps.

The invention is based on the recognition that maintenance of the moistener assembly by an operator is more easily possible when it can be exclusively, effectively undertaken from above. This is accomplished by the moistener rocker being accessible from above and being spring-mounted such that it can rotate on an associated hinge on the blade and can be locked in a maintenance position by a locking contour.

The above objects also are achieved by the upper part and lower part of the moistener being connected by fastening with connection elements that can be detached exclusively from above. Accidental spilling of the residual water thus is prevented during a regular cleaning interval. The above objects are also achieved by an antibacterial lower water transfer element in the lower part and an antibacterial upper moistening elements in the upper part which, by bending the upper end of the lower water transfer element, have an enlarged contact area (surface) for water transfer with one another. The edge of the upper moistening element, which is farther from the placement and guidance wall of the upper part, exhibits a greater width in the transport direction than its edge close to the placement and guide wall. The upper moistening element has a clamp region held in a clamp groove of the moistener rocker and is easily accessible with the rocker in an opened position.

The water-filling port has an oval, large opening oriented forwardly relative to the operator, below the spring-mounted moistener rocker, that can be brought into a maintenance position. The water-filling port is deep and visibly narrowed towards the bottom so that the water surface lies at its maximum level upon reaching the water-filling socket. The moistener rocker covers the filling opening. It can be pivoted upwardly via a recessed grip and locks in this position in order to enable simplified filling of the tank.

A locking contour is integrated on the blade and spring-catches behind a projector on the moistener rocker and thus uncovers the filling socket. By finger pressure, the catching can be overcome and the water-filling nozzle is covered again. The moistener rocker with pressure spring retainer and clamping groove for the upper moistening means is clipped on the blade in a contour supported on both sides. The spring-locking contours of the rotation axle are advantageously located on the moistener rocker, that can be exchanged easily and without tools. The water transfer and moistening arrangement is formed of highly absorbent artificial felt of low density, so mold and mildew formation are prevented while also extending the lifespan.

The contact surfaces of the lower water transfer element and the upper moistening element have been significantly enlarged in order to be able to transfer sufficient water in the short (under the circumstances) time between each flap moistening. The shape of the contact surface of the moistening element resembles a with its top cut off, making it triangular sail trapezoidal, such that its water storage capability grows in areas with the greater distance from the placement and guide wall. Both elements can be simply exchanged since they can be unclamped and slid out without auxiliary mounting in contours in the cladding on the moistener rocker such as the conventional (felt mounting contours).

DESCRIPTION OF THE PREFERRED EMBODIMENTS

Figure 1:
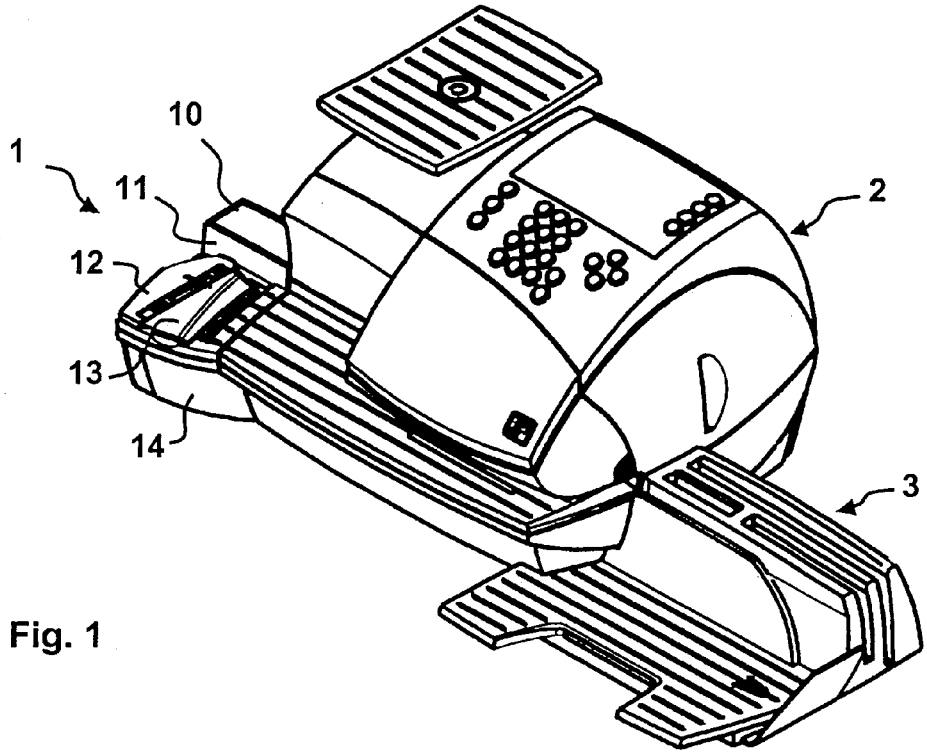
FIG. 1 is a perspective view of a system with a manual moistener, a franking machine and a tray in accordance with the invention.

FIG. 1 is a perspective view of a system with a manual moistener 1, a franking machine 2 and a tray 3, the manually operated moistener 1 being upstream from the franking machine 2 in terms of the mail flow. The operation ensues with a slanted placement of a mail item on the manual moistener 1 with its flap away from the vertical letter placement wall 11. The front part of the flap, lying beneath the envelope body, is shifted against the sharp-edged, acute-angled front side of a blade 12. If the flap of the letter hooks on the blade 12, the operator notices a marked resistance, the flap is caught and, upon further shifting, the letter can be rotated into the blade 12 parallel to the vertical letter placement wall 11. The blade 12 does not extend upstream in terms of the mail flow over the region that is defined by the beginning of a surface of the upper part 10 and the vertical letter placement wall 11. A moistener rocker 13 disposed following the blade 12 wets the flap with moisture. If the letter slides off over the blade 12, the flap could consequently not be caught and a reattempt of the letter placement is necessary. The vertical letter placement wall 11 terminates at the top with the surface of the upper part 10 of the moistener 1 and extends until the coupling point of the moistener 1 on the franking machine 2. The bottom part 14 of the moistener 1 serves as a water tank.

Figure 2:
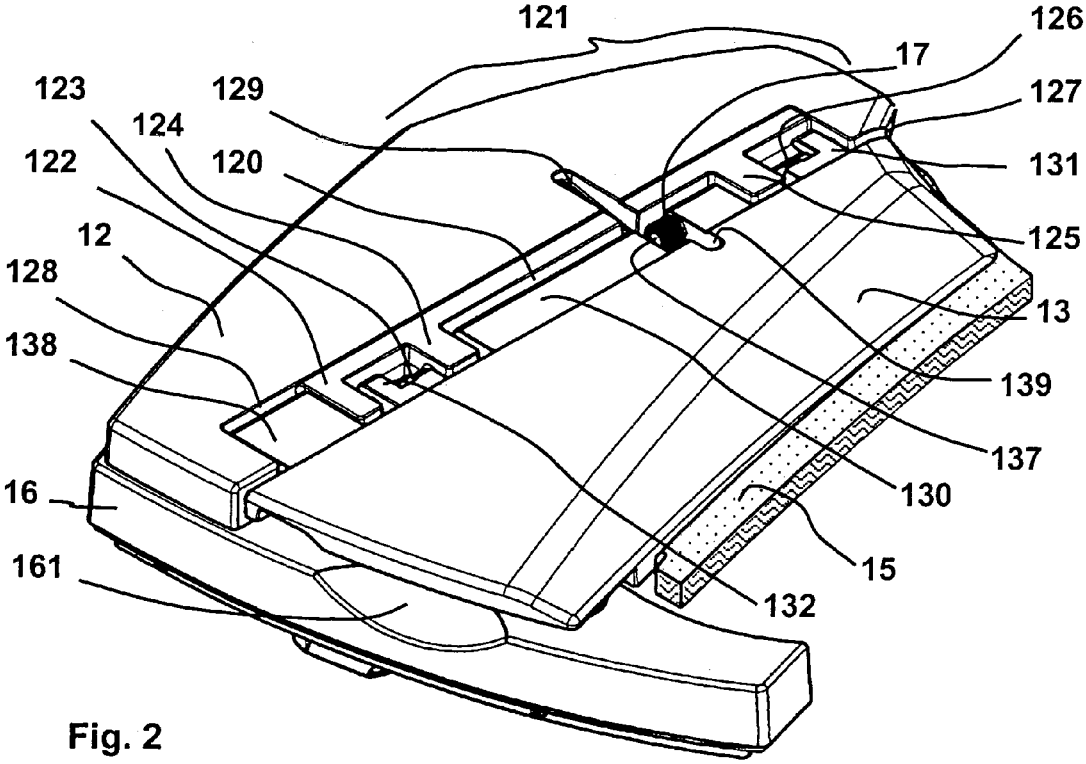
FIG. 2 is a perspective view of superstructural parts of an upper part of the manual moistener with a moistener rocker in operating position in accordance with the invention.

A perspective view of superstructural parts is shown in FIG. 2 on the upper part 10 of the manual moistener 1 with the moistener rocker 13 in the operating position. The blade 12 with a blade carrier 16 is integrally molded on the side facing away from the vertical letter placement wall 11, or alternatively is connected with the carrier 16 with a positive fit. The blade 12 has an arc-shaped contour 121 on its side directed upstream in terms of the mail flow and at its point facing towards the vertical letter placement wall 11 at which the letter envelopes arrive with their flaps. The blade contour (arrival arc) lies completely in the region of the vertical letter placement 11, which serves as a placement and guidance wall for the edge of the mail pieces (not shown).

On its other side facing downstream in terms of mail flow, the blade 12 has an opening 120 with at least one hinge 123, 126 supported on both sides in order to enable a rotational motion of the moistener rocker 13. On the side of the blade 12 facing away from the vertical letter placement wall 11, first supports 122, 124 of the first hinge 123 are integrally molded on both sides, and second supports 125, 127 of the second hinge 126 are integrally molded on both sides of the side of the blade 12 facing toward the vertical letter placement wall 11. Both hinges 123, 126 lie on the same axial line and serve for rotatable fastening of the moistener rocker 13. A first notch 128 for locking contours of the moistener rocker 13 is molded into the blade between the first support 122 and the outer edge of the blade 12. A second notch 129 for spring support is molded between the block 124 of the first support 122, 124 lying at the blade middle, and the block 125 of the second support 125, 127 lying at the blade middle. The moistening rocker 13 has a retaining contour 138 shaped corresponding to the first notch 128 and a third notch 129 for spring support shaped corresponding to the second notch 129. The third notch 139 lies in an edge contour 130 of the moistener rocker 13 and merges in the edge contour into an opening with a peg 137 that enables a guidance and support of the spring 17. Locking contours 131, 132 are molded into the edge contour 130 of the moistener rocker 13.

The moistener rocker 13 can be opened upwardly and locked by the locking contours 131, 132 on its rotation axis. The locking contours 131, 132 of the moistener rocker 13 are engaged with at least one hinge 123, 124 of the blade 12. The moistener rocker 13 is equipped with an exchangeable water transfer element 15 which, by the spring 17, is pressed against the adhesive edge of the flap of a letter envelope as it is guided through. The blade carrier 16 has a grip recess 161 allowing the moistener rocker 13 to be grasped to bring it into a maintenance position in which the retaining contour 138 locks (see FIG. 4).

Figure 3:
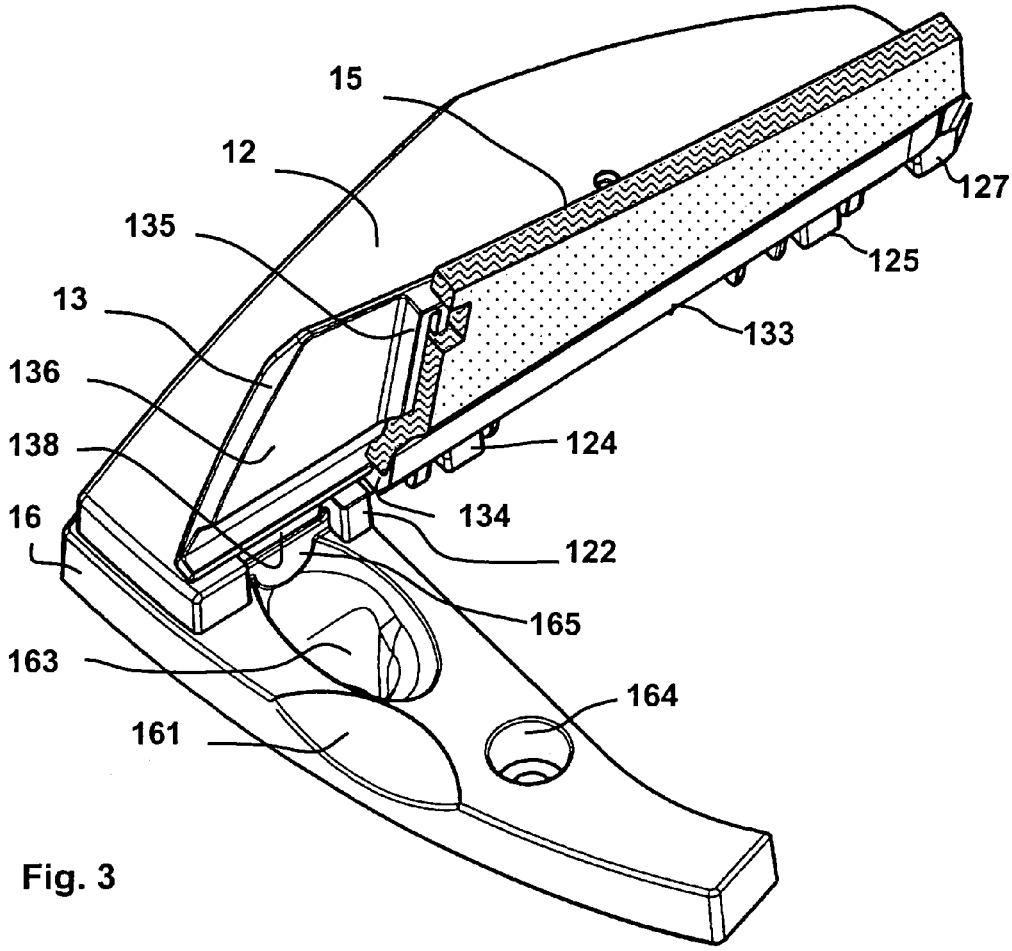
FIG. 3 is a perspective view of superstructural parts of an upper part of the manual moistener with a moistener rocker in maintenance position in accordance with the invention.

A perspective view of superstructural parts on an upper part of the manual moistener 1 is shown in FIG. 3 with the moistener rocker 13 in the maintenance position. The moistener rocker 13 bears a contour on the underside 136 on the side facing away from the vertical letter placement wall 11. The contour covers openings in the blade carrier 16 in the operating position of the moistener rocker 13 and uncovers the openings 163, 164 when the rocker 13 is in a maintenance position. The blade carrier 16 has a water filling funnel 163 and an opening 164 for a connection element (not shown) which, in the operating position, are completely covered, in contrast to the grip recess 161 that is only partially covered. The integrally molded blocks 122, 124 and 125, 127 of the first and second supports of the first and second hinges 123 and 126, through which the rotational axis of the moistener rocker 13 proceeds, are visible on the blade 12. A planar spray protection wall 165 is integrally molded on an inner wall of the water-filling funnel 163 on the side facing toward the blade 12. The outside of the spray protection wall 165 is likewise planar and serves as a stop for the retaining contour 138 of the moistener rocker 13. The moistener rocker 13 therefore cannot be opened further when its retaining contour 138 arrives at the stop. A fixing contour 135 forms a boundary wall for the upper moistener element 15 inserted into a clamping groove 134. The clamping groove is formed by a clamping bar 133 and the underside 136 of the moistener rocker 13.

Figure 4:
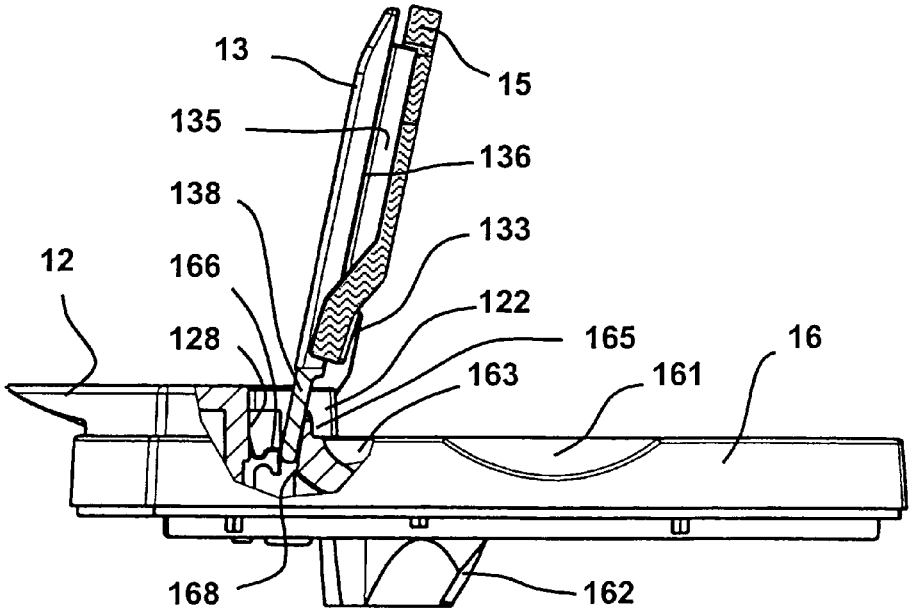
FIG. 4 is a sectioned front view of the upper part of the manual moistener with a moistener rocker in maintenance position in accordance with the invention.

A sectional front view of the upper part of the manual moistener is shown in FIG. 4 with the moistener rocker 13 in the maintenance position. The section passes only through a detail which shows the spray protection wall 165 and its backside as a stop for the retaining contour 138 of the moistener rocker 13. The part 15 of the water transfer element arranged on the moistener rocker 13 is retained between clamping bar 133 and the underside 136 of the moistener rocker 13 and is secured from sliding by a fixing contour 135. The first notch 128 in the blade 12 for the retaining contour 138 leads to a lobe-shaped, spring-mounted projection 166 of the blade carrier 16. The moistener rocker 13 catches (locks) between the projection 166 and the stop 168 after a grasping in the grip recess 161 and the opening of the moistener rocker 13 until the stop 168 on the backside of the planar spray protection wall 165 of the otherwise funnel-shaped water filling opening 163. Water can now be filled without problem via the funnel-shaped water filling opening 163 of the water-filling nozzle.

Figure 5B:
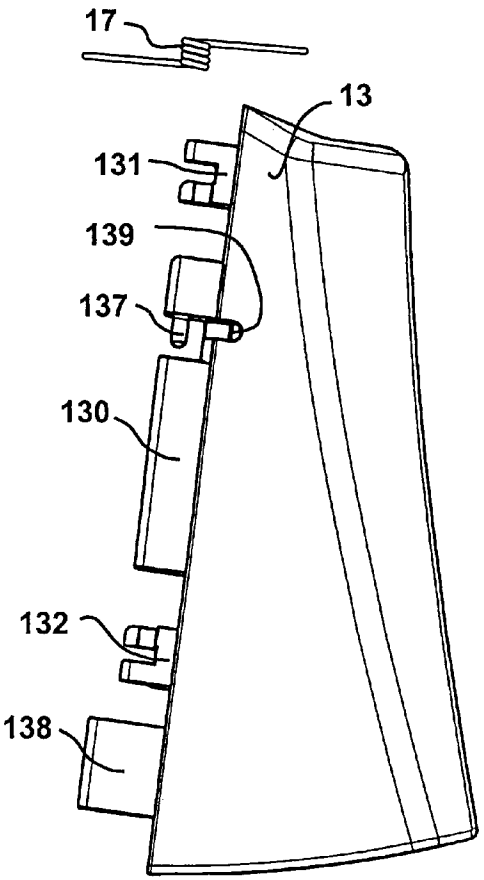
FIG. 5*b* is a plan view of the moistener rocker in accordance with the invention.
Figure 5C:
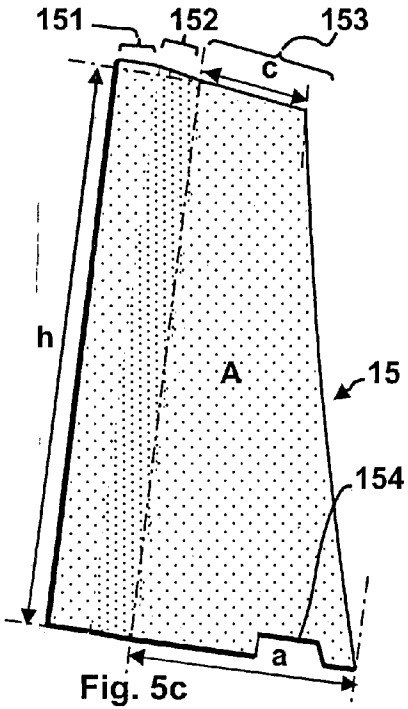
FIG. 5*c* is a plan view of the moistening element in accordance with the invention.
Figure 5A:
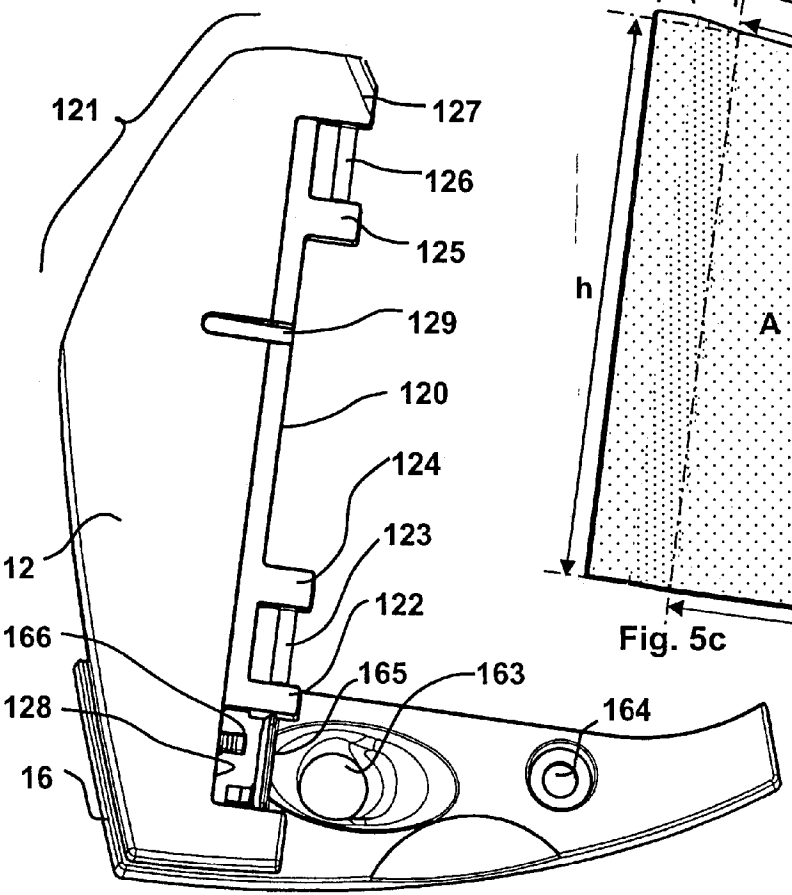
FIG. 5*a* is a plan view of blade carrier and blade of the manual moistener with the moistener rocker removed in accordance with the invention.

FIG. 5*a* shows a plan view of the blade carrier 16 and blade 12 of the manual moistener with the moistener rocker 13 removed. An arm of the blade carrier 16 that extends downstream in terms of the mail flow of the blade 12 is next to the downstream-directed opening 120 on the blade 12 relative to the placement and guidance wall 11. The water filling opening 163 in the arm of the blade carrier 16 has the planar spray protection wall 165 whose back side serves as a stop for the retaining contour of the moistener rocker 13 and lies in an opening in the section in which blade 12 and blade carrier 16 are connected. The opening in the blade 12 is formed by the first notch 128 in the blade 12 for the retaining contour. The lobe-shaped projection 166 of the blade carrier 16, the design of which sets the locking behavior of the moistener rocker 13, is arranged at the transition from the blade 12 to the blade carrier 16. The opening 164 for a connection element lies in the tapering end of the arm of the blade carrier 16 next to the water filling opening 163. The supports 122, 124 and 125, 127 on both sides of the hinges 123, 126 and the second notch 129 for spring support are arranged on the blade 12 at the edge of the opening 120 directed downstream in terms of mail flow. A contour 121 is integrated upstream in terms of mail flow on the blade, the contour 121 forming what is known as the arrival curve.

FIG. 5*b* shows a plan view of the moistener rocker 13 without the moistening element. A peg 137 for the mountable spring 17 is arranged in an opening of the moistener rocker 13, whereby the opening is molded corresponding to the tolerances of the spring 17 and opposite the second notch 129 of the blade 12, in an edge contour 130 of the moistener rocker 13. The latter has at the opening a third notch 139 in the moistener rocker 13 for spring support. Furthermore, locking contours 131, 132 which are fashioned such that the can plug into the hinges 123, 126 are molded on both sides of the edge contour 130. A retaining contour 138 of the moistener rocker 13 overhangs its edge contour 130.

Figure 6:
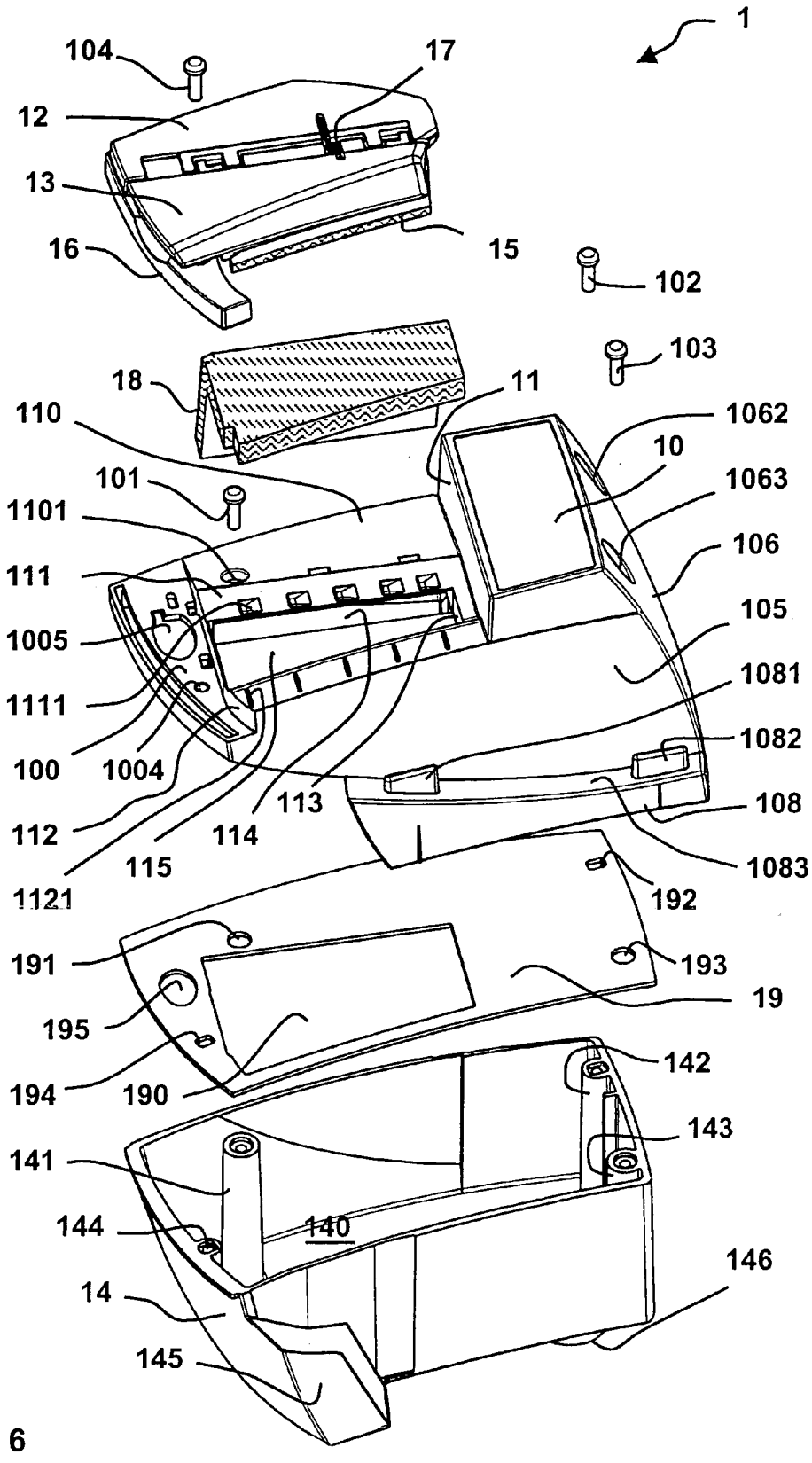
FIG. 6 is a perspective view of the manual moistener from the upper right in an exploded view in accordance with the invention.

FIG. 5*c* shows a plan view of the moistening element 15 which, like the water transfer element 18 shown in FIG. 6, preferably formed of felt, which guarantees an easy wetting capability. The contact surface 153, which has triangular sail-shape up to a trapezoidal shape with the surface area $A=(a+c)\cdot h/2$ and a recess 154 for assisting installation, joins on the rectangular surface 151 in the clamping region and the approximately rectangular surface 152 in the transition region.

FIG. 6 shows a perspective view of the manual moistener from the upper right in an exploded view. The blade 12, the moistener rocker 13 with the moistening element 15 and the spring 17 are arranged on the blade carrier 16. The water transfer element 18 disposed below the moistening element 15 can be plugged at its lower end into a slit-shaped opening 114 of the upper part 10 of the manual moistener. The lower end of the water transfer element 18 extends into the bottom part 14 of the moistener, which is fashioned as a water tank. The water transfer element 18 is curved at its other upper end and abuts the moistening element 15, such that each of the moistening element 15 and the water transfer element 18 have a contact surface 153 (see FIG. 5*c*) for water transfer that is enlarged by the curvature.

The upper part 10 and the lower part 14 of the moistener can be connected by means of connection elements 101, 102, 103 and 104, with a seal 19 being arranged between upper part 10 and lower part 14. The connection element 104 is, for example, a screw that can be inserted into an opening 164 (visible in FIG. 3) and is detachably connected from above with a dome 144 of the lower part 14 via an opening 1004 in a tabletop 100 of the upper part 10 and via an opening 194 of the seal 19. The dome 144 has an opening that, if necessary can be equipped with an inner threading for the screw.

Openings 1062 and 1063 for connection elements 102 and 103 are incorporated on the backside 106 of the upper part 10, with corresponding openings 192 and 193 being provided in the seal 19 and domes 142 and 143 in the lower part 14. Through the openings 192 and 193, the connection elements 102 and 103 can be detachably connected from above.

Figure 7:
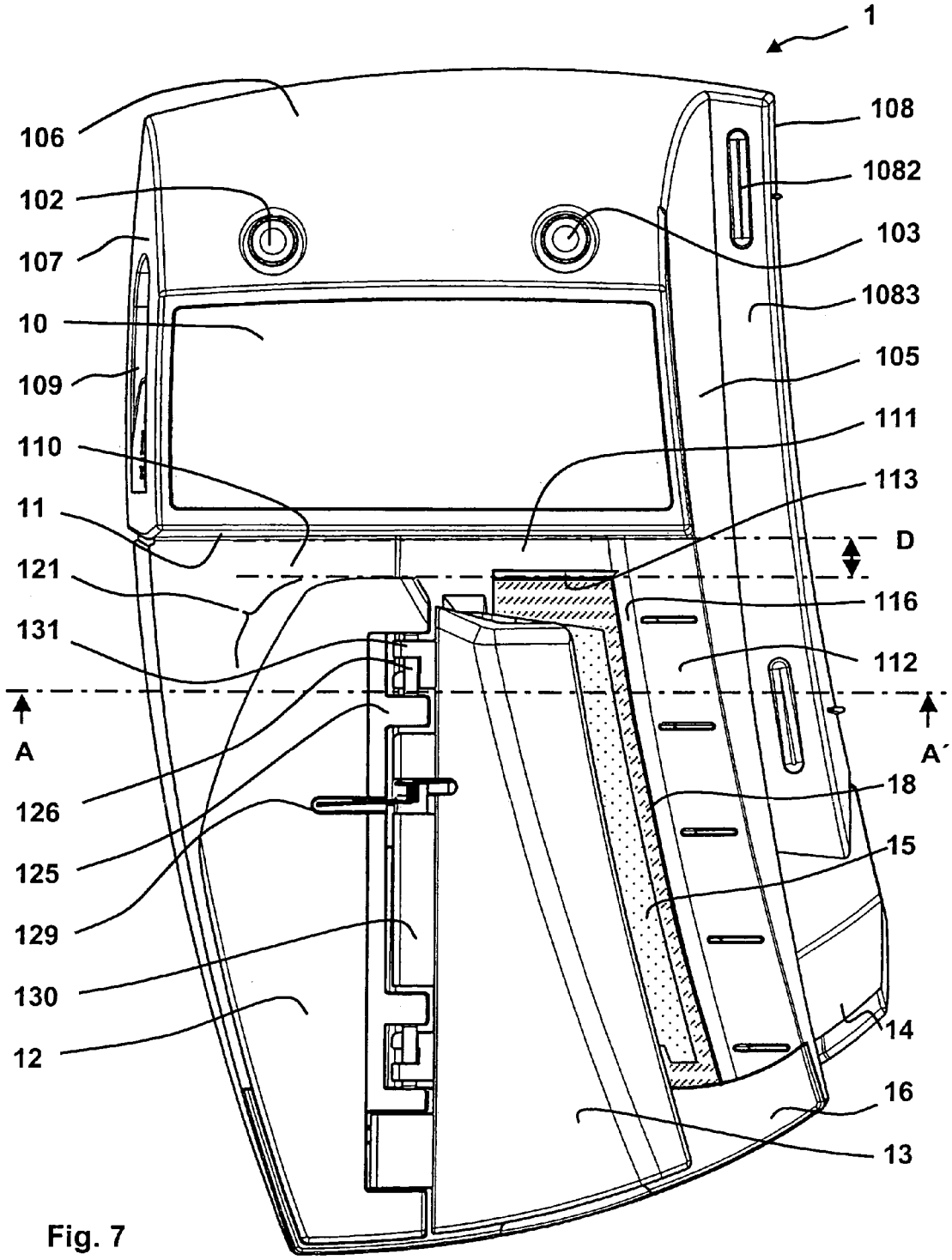
FIG. 7 is a plan view of the manual moistener in accordance with the invention.

The upper part 10 has side walls 105 and 107 as shown in FIG. 7 which cover the lower part 14 in the assembled state. A base 108 has a step of flange on the lower edge of the right side wall 105, with centering projections 1081 and 1082 mounted on the step surface 1083 facing upwardly. The manual moistener 1 can be modularly connected with the franking machine 2 by means of the centering projections 1081 and 1082 and can be removed again by gently lifting from the franking machine 2.

A step 111 on the placement and guidance wall 11 is provided on a tabletop 100 of the upper part 10. Downstream (in terms of the mail flow) of the first step 111, a further step 112 is attached in an ascending manner on the placement and guiding wall 11. The further step 112 supports bearing rails 1121 . . . 112*x* in order to ensure frictionless transfer of a mail piece to the franking machine. Upstream (in terms of the mail flow) of the first step 111, a feed incline 110 is attached in a descending manner on the placement and guidance wall 11. An opening 1101 for a connection element 101, for example a screw, is introduced into the feed incline 110 in order to enable a screw connection with a dome 141 of the lower part 14 via an opening 191 in the seal. An opening 1005 is provided in the table top 100 of the upper part 10 that accommodates the water filling nozzle (covered) of the blade carrier 16 for which a corresponding opening 19 is provided in the seal 19 whose main opening 190 is arranged from the center of the first step 111 until near the edge (situated downstream in terms of mail flow) of the seal 19. The main opening 190 accommodates the water transfer element 18, one end of which extends into the water stored in the inner tank chamber 140.

The other end of the water transfer element 18 proceeds through the slit-shaped opening 114 on a bearing surface 115 of the upper part 10 which is arranged on the base of a shaft 113 within the first step 111, whereby the shaft 113 reaches up to the further step 112. The water transfer element 18 is fastened by clamping below the further step 112. Between the shaft 113 and an edge which is formed by feed incline 110 and the first step 111, projection-shaped spacing bodies 1111 . . . 111*x* are arranged on the first step 111 in order to ensure a separation between the envelope flap and water transfer element 18 when a letter envelope is slid through by the manual moistener 1. The entire lower part 14 of the moistener 1 is formed of a visible, transparent water tank that exhibits max./min. water level markings (not shown) on the front and clearly visible windows for water level checking. The remaining outer surfaces of the lower part can be designed rough and are thus semi-transparent. A projection 145 that enlarges its water containing capability can be integrally molded on the water tank on the side facing toward the franking machine 2. The lower part 14 of the moistener 1 stands on four integrally molded feet 146, 147, 148 and 149, of which only the first is visible in FIG. 6.

A plan view of the manual moistener 1 is shown in FIG. 7. The side walls 105, 107, the back wall 106 and the placement and guidance wall 11 of the moistener 1 are integrally molded on its upper part 10. For fastening of the upper part 10 and the lower part 14, screws or similar connection elements 102, 103 are arranged in the back wall 106 such that they are easily accessible from above and can be screwed in or plugged in. All connection elements of the upper and lower parts are accessible from above, covered in the front viewing area by the blade 16 or the moistener rocker 13 and are countersunk into the housing back wall so that no optical impairment of the design occurs.

The base 108 has the upper step surface 1083 on which at least one centering projection 1082 is attached on the right side wall 105. A window 109 that exposes a display surface of the lower part 14 is incorporated into the left side wall 107. The feed incline 110, the first step 111 and the further ascending step 112 are integrally molded into the placement and guidance wall 11. A transfer incline 116 for the flap of the mail piece to be closed is arranged in the mail flow between the first step 111 and the step edge of the further step 112. The shaft 113 for the water transfer element 18 is molded in the first step 111. The water transfer element 18 wets the moistening element 15 of the moistener rocker 13 with water in the operating position when no mail piece abuts the manual moistener 1 and is directed through. The blade carrier 16 separated from the placement and guidance wall 11 and mounted on the edge at the front side of the manual moistener on its table top (covered) carries the blade 12 which exhibits an entrance area near the placement and guidance wall 11. A distance D within a range of approximately 3 mm to 20 mm exists at the nearest point. The blade 16 has at least one hinge 126 at the block 125 between the notch 129 for spring support and the point of the blade 12, in which hinge 126 at least one locking contour 131 engages the moistener rocker 13. The rotation axle runs inside of or outside of the edge contour 130 of the moistener rocker 13. A marked dash/dot line AA' clarifies the section through the plan view of the manual moistener 1 which is subsequently explained in detail using a sectional view (FIG. 8).

Figure 8:
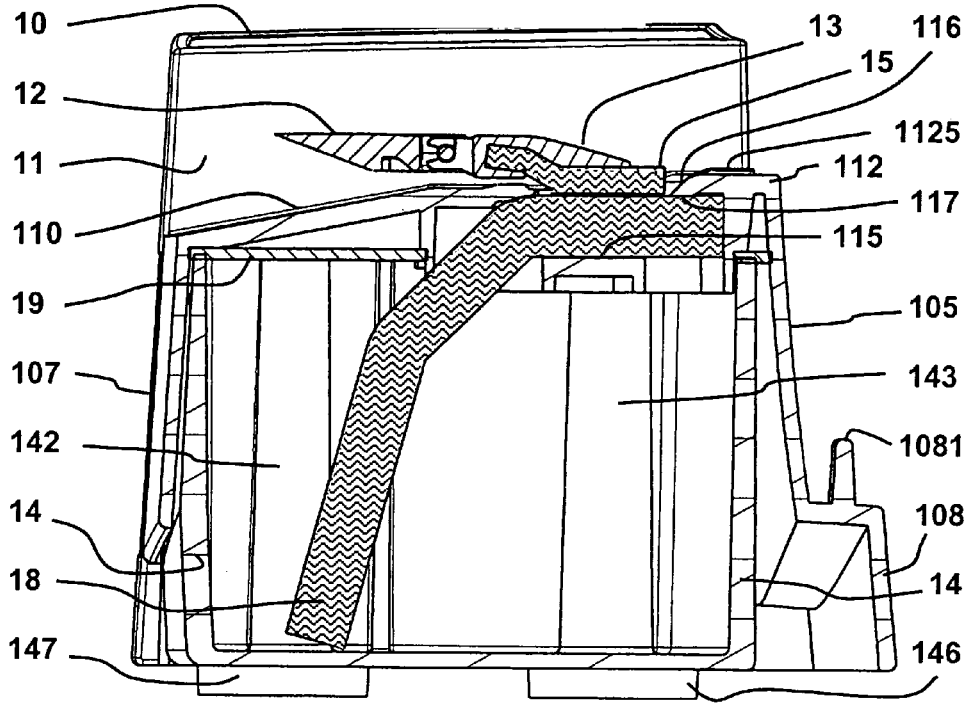
FIG. 8 is a sectioned front view of the manual moistener in accordance with the invention.

FIG. 8 shows a sectioned front view of the manual moistener with an upper part of the moistener 10, with the right and left side walls 105 and 107, the base 108, the centering projection 1081, the placement and guidance wall (vertical letter placement wall) 11, the blade 12, the moistener rocker 13, a lower part of the moistener (water tank) 14, with feet 146, 147 with domes 142, 143 and a seal 19. The feed incline 110 and the support surface 115 for lower water transfer element 18 are attached on the placement and guidance wall (vertical letter placement wall) 11. The water transfer element 18 is pinched in a second slit-shaped opening 117 in the transport incline 116 at the further step 112. The contact between the upper moistening element 15 and the lower water transfer means 18 is interrupted only upon moistening, when a letter flap (not shown) is shifted between them.

Figure 9:
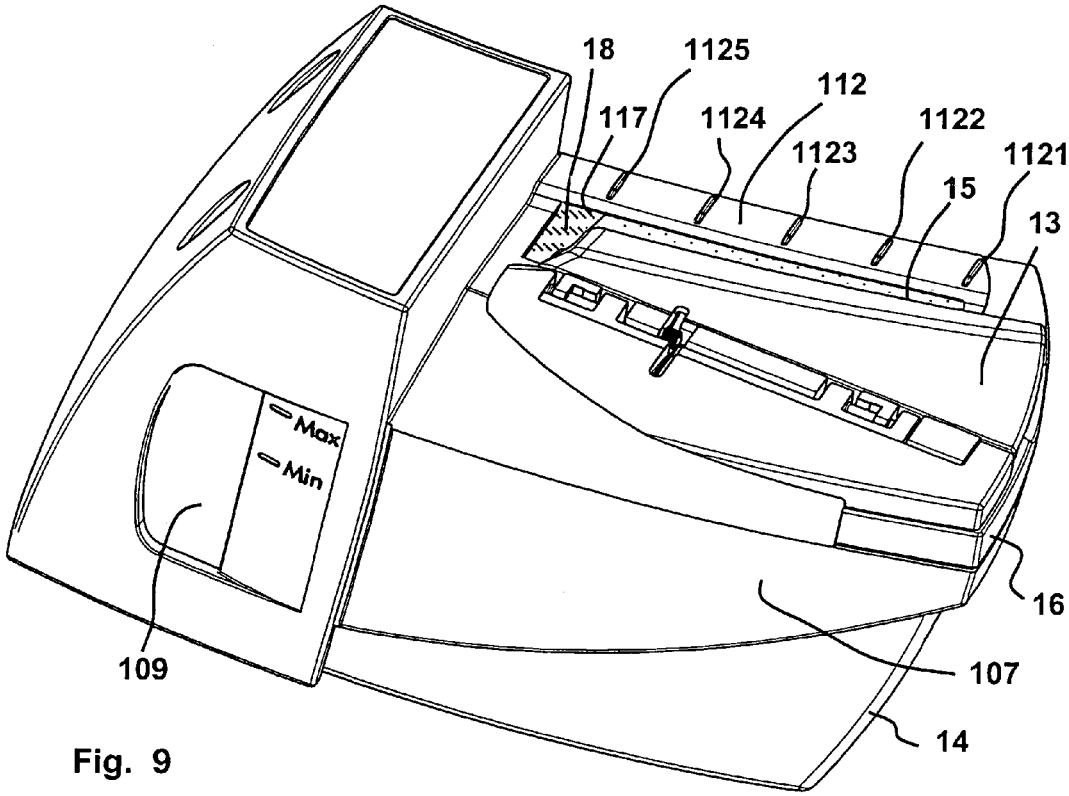
FIG. 9 is a perspective partial view of the manual moistener from the upper left with a moistener rocker in the operating position in accordance with the invention.

FIG. 9 shows a perspective view of a portion of the manual moistener from the upper left with the moistener rocker 13 in the operating position. The left side wall 107 of the upper part 10 of the moistener 1 has a window 109. The lower part of the moistener (water tank) 14 is comprised of a transparent material. The easier maintenance of the moistener assembly is achieved via an improvement of the easy recognition capability of the water level by means of a transparent tank. The lower water transfer element 18 and the upper moistening element 15 are formed of an artificial felt with easy wetting capability that requires little maintenance. The advantages of the synthetic felt are:

cheaper hygienic, since no mold infestation more resistant than natural felt more absorbent, for example for water, more temperature-resistant than natural felt. The water transfer element 18 may be an antibacterial artificial felt, for example a needled felt made from polyester. An antibacterial artificial felt by the company Vereinigte Filzfabriken AG (VFG) is suitable. Rails 1121 through 1125 are mounted on the step 112 at the outlet of the manual moistener 1. This allows, among other things, the maintenance of the manual moistener 1 to ensue from above, which requires numerous components to be designed so that the moistener rocker 13, that can be opened upwardly can be locked in a maintenance position which likewise (like a fastening via the connection elements that can be loosened only from above) makes filling easier and helps prevent spillage of water. The covering of the funnel-shaped water filling opening 163 by the moistener rocker 13 brought into the operating position, reduces evaporation, which extends the maintenance interval. The antibacterial water transfer element 18 and the moistening element 15 contribute to the extension of the maintenance interval with the moistening element 15 being arranged in the moistener rocker 13 SO as to be easily accessible from above to make the maintenance easier. The deviation of the moistening element 15 transverse to the transport direction of the mail pieces is selected so that a sufficient wetting is also ensured for long flaps lying transversally, while at the same time the felt area located in contact with the lower water transport means is enlarged. For example, the contact surface near the flap fold is 14 mm, however is already 29 mm wide at the flap point. The edge c of the contact surface 153 near the placement and guidance wall 11 of the upper part 10 in the transport direction thus exhibits a smaller width than its edge a distanced from the placement and guidance wall 11. The edge a is broadened to 29 mm in the transport direction. The contact surface of the moistening element 15 has a triangular sail-like to trapezoidal form. The contact surface from the flap fold to the flap tip is in this manner preferably larger as the adhesive surface to be wetted increases in the most disadvantageous case. The contact surface should be larger than A =600 $mm^2$ and smaller than A =2500 $mm^2$. The rectangular surface 151 in the clamping region and the square area 152 in the transition region should be larger than 5 ×60 $mm^2$ and smaller than 10 ×80 $mm^2$. The felt thickness and density are selected so that the upper felt is flexible and thin so that it always lies on the lower felt, even given an uneven lower felt or disadvantageous tolerance design, i.e. non-parallelism of the upper and lower felt. The thinner upper felt here requires no separate mounting, but rather is inserted directly into the clamping groove 134 on the underside of the upper moistener rocker 13.

Although modifications and changes may be suggested by those skilled in the art, it is the inventor to embody within the patent warranted hereon all changes and modifications as reasonably and properly come within the scope of his contribution to the art.

I claim:

1. A manually operated moistener for moistening a liquid-activatable glue on a flap of an envelope attached to an envelope body, said moistener comprising:

an upper part having a substantially vertical placement wall adjoining a substantially horizontal platform;

a blade and rocker assembly attached to said platform, said blade and rocker assembly comprising a blade configured to interact with the flap of an envelope manually supplied to the blade with the flap beneath the envelope body and away from said placement wall, and a moistener rocker attached by a hinge to said blade allowing said moistener rocker to be opened upwardly by rotation with respect to said hinge, a spring biasing said moistener rocker being at said hinge, and said hinge comprising a locking arrangement that locks said moistener rocker, when opened upwardly, in an upwardly open position against a force exerted by said spring;

a lower part forming a liquid tank, said lower part being attached below said upper part by releasable fastening elements that are released exclusively from above through said upper part;

an anti-bacterial water transfer element comprised of anti-bacterial material and having a lower portion extending into said lower part and a curved upper portion mounted in said upper part;

an anti-bacterial moistening element comprised of anti-bacterial material and mounted in said upper part abutting said curved upper portion of said water transfer element with a contact surface allowing water transfer between said water transfer element and said moistening element;

said moistener rocker having a clamping groove and said moistening element having a clamping region held in said clamping groove; and said flap of said envelope being manually moved against said moistening element in a transport direction as the envelope is manually supplied to the blade, and said moistening element being mounted in said moistener rocker with a first edge of said moistening element closer to said placement wall than a second edge of said moistening element, said second edge having a larger width in said transport direction than said first edge.

2. A manually operated moistener as claimed in claim 1 comprising:

a blade carrier to which said blade is attached, said blade having a notch therein above said blade carrier;

said blade carrier having a water filling opening therein communicating with said water tank in said lower part and having a planar spray protection wall; and said locking arrangement comprising a resilient projection of said blade carrier projecting into an open region beneath said notch, and a stop element disposed at a backside of said spray protection wall, in said opening of said blade carrier, said stop element being spaced from said projection, and a retaining contour of said moistener rocker that locks between said projection and said stop element, when said moistener rocker is rotated on said hinge to said open position.

3. A manually operated moistener as claimed in claim 2 wherein said blade carrier comprises a grip recess disposed beneath said moistener rocker at a side of said blade carrier facing away from said placement wall.

4. A manually operated moistener as claimed in claim 2 wherein said blade carrier has an arm extending downstream from said blade in said transport direction, said arm being disposed at a side of said blade carrier facing away from said placement wall, said water filling opening being disposed in said arm, and said arm having a water filling nozzle communicating with said water filing opening for directing water through said water filling opening into said water tank.

5. A manually operated moistener as claimed in claim 4 wherein said opening and said water filling nozzle have an oval shape.

6. A manually operated moistener as claimed in claim 4 comprising a liquid seal disposed between a top of said lower part and a bottom of said upper part, said liquid seal having a plurality of openings therein respectively allowing said connection elements to proceed through said liquid seal; and a plurality of domes extending from a bottom of said lower part to said top of said lower part, each of said domes having a receptacle therein for detachably receiving one of said fastening elements, one of said domes being disposed beneath said arm of said blade carrier and one of said fastening elements proceeding through said arm of said blade carrier.

7. A manually operated moistener as claimed in claim 6 wherein said platform of said upper part has an opening therein through which said water filing nozzle of said blade carrier extends, and wherein said seal has an opening in registration therewith through which water filling nozzle also extends.

8. A manually operated moistener as claimed in claim 1 configured for attachment to a franking machine, and wherein said platform comprises a first step and a second step disposed in succession in said transport direction with said second step being higher than said first step, said second step comprising a plurality of support rails configured for smooth transfer of said envelope to said franking machine, and further comprising a feed incline connected to said platform, upstream of said first step in said transport direction, inclined to descend toward said placement wall.

9. A manually operated moistener as claimed in claim 8 wherein said feed incline has an opening therein through which one of said fastening elements proceeds to make a releasable connection with said lower part.

10. A manually operated moistener as claimed in claim 8 comprising:

a liquid seal disposed between said upper part and said lower part, said liquid seal having an opening therein through which said water transfer element proceeds; and said upper part having a shaft on said first step extending to said second step, and a support surface disposed at a base of said shaft, said support surface having an opening therein in registration with said opening in said seal, through which said water transfer element also proceeds, and said second step having an opening therein in which said water transfer element is clamped.

11. A manually operated moistener as claimed in claim 10 comprising a plurality of spacing elements projecting from said first step between said shaft and an edge formed by said feed incline and said first step.

12. A manually operated moistener as claimed in claim 10 wherein said moistener element has a trapezoidally shaped contact surface with said water transfer element, having a water storage capacity that increases with increasing distance from said placement wall.

13. A manually operated moistener for moistening a liquid-activatable glue on a flap of an envelope attached to an envelope body, said moistener being configured for attachment to a franking machine and comprising:

an upper part having a substantially vertical placement wall adjoining a substantially horizontal platform;

a blade and rocker assembly attached to said platform, said blade and rocker assembly comprising a blade configured to interact with the flap of an envelope manually supplied to the blade with the flap beneath the envelope body and away from said placement wall;

a lower part forming a liquid tank configured to contain liquid therein, said lower part being having an open top attached below said upper part, with said upper part covering and closing said open top, by releasable fastening elements that are released exclusively from above through said upper part to permit detachment of said upper part from said liquid tank exclusively from above for maintenance of said lower part;

a liquid transfer element having a lower portion extending into said lower part and a curved upper portion mounted in said upper part;

a moistening element mounted in said upper part abutting said curved upper portion of said liquid transfer element with a contact surface allowing liquid transfer between said liquid transfer element and said moistening element, said flap of said envelope being manually moved against said moistening element in a transport direction as said envelope is manually supplied to the blade;

said platform comprising a first step and a second step disposed in succession in said transport direction with said second step being higher than said first step, said second step comprising a plurality of support rails configured for smooth transfer of said envelope to said franking machine, and further comprising a feed incline connected to said platform, upstream of said first step in said transport direction, inclined to descend toward said placement wall, said feed incline having an opening therein through which one of said fastening elements proceeds to make a releasable connection with said lower part, and said platform comprising a plurality of spacing elements projecting from said first step between said shaft and an edge formed by said feed incline and said first step;

a liquid seal disposed between said upper part and said lower part, said liquid seal having an opening therein through which said liquid transfer element proceeds; and said upper part having a shaft on said first step extending to said second step, and a support surface disposed at a base of said shaft, said support surface having an opening therein in registration with said opening in said seal, through which said liquid transfer element also proceeds, and said second step having an opening therein in which said liquid transfer element is clamped.

14. A manually operated moistener for moistening a liquid-activatable glue on a flap of an envelope attached to an envelope body, said moistener comprising:

an upper part having a substantially vertical placement wall adjoining a substantially horizontal platform;

a blade and rocker assembly attached to said platform, said blade and rocker assembly comprising a blade configured to interact with the flap of an envelope manually supplied to the blade with the flap beneath the envelope body an away from said placement wall, and a moistener rocker attached by a hinge to said blade allowing said moistener rocker to be opened upwardly by rotation with respect to said hinge, a spring biasing said moistener rocker being at said hinge, and said hinge comprising a locking arrangement that locks said moistener rocker, when opened upwardly, in an upwardly opened position against a force exerted by said spring;

a lower part attached below said upper part and forming a liquid tank;

a liquid transfer element having a lower portion extending into said lower part and a curved upper portion mounted in said upper part; and a moistening element mounted in said upper part abutting said curved upper portion of said liquid transfer element with a contact surface allowing liquid transfer between said liquid transfer element and said moistening element, said flap of said envelope being manually moved against said moistening element in a transport direction as said envelope is manually supplied to said blade.

15. A manually operated moistener as claimed in claim 14 comprising:

a blade carrier to which said blade is attached, said blade having a notch therein above said blade carrier;

said blade carrier having a water filling opening therein communicating with said liquid tank in said lower part and having a planar spray protection wall; and said locking arrangement comprising a resilient projection of said blade carrier projecting into an open region beneath said notch, and a stop element disposed at a backside of said spray protection wall, in said opening of said blade carrier, said stop element being spaced from said projection, and a retaining contour of said moistener rocker that locks between said projection and said stop element, when said moistener rocker is rotated on said hinge to said open position.

16. A manually operated moistener as claimed in claim 15 wherein said blade carrier comprises a grip recess disposed beneath said moistener rocker at a side of said blade carrier facing away from said placement wall.

17. A manually operated moistener as claimed in claim 15 wherein said blade carrier has an arm extending downstream from said blade in said transport direction, said arm being disposed at a side of said blade carrier facing away from said placement wall, said water filling opening being disposed in said arm, and said arm having a liquid filling nozzle communicating with said liquid filing opening for directing liquid through said liquid filling opening into said liquid tank.

18. A manually operated moistener as claimed in claim 17 wherein said opening and said liquid filling nozzle have an oval shape.

19. A manually operated moistener as claimed in claim 17 comprising a liquid seal disposed between a top of said lower part and a bottom of said upper part, said liquid seal having a plurality of openings therein respectively allowing said connection elements to proceed through said liquid seal; and a plurality of domes extending from a bottom of said lower part to said top of said lower part, each of said domes having a receptacle therein for detachably receiving one of said fastening elements, one of said domes being disposed beneath said arm of said blade carrier and one of said fastening elements proceeding through said arm of said blade carrier.

20. A manually operated moistener as claimed in claim 19 wherein said platform of said upper part has an opening therein through which said water filing nozzle of said blade carrier extends, and wherein said seal has an opening in registration therewith through which water filling nozzle also extends.

21. A manually operated moistener for moistening a liquid-activatable glue on a flap of an envelope attached to an envelope body, said moistener comprising:

an upper part having a substantially vertical placement wall adjoining a substantially horizontal platform;

a blade and rocker assembly attached to said platform, said blade and rocker assembly comprising a blade configured to interact with the flap of an envelope manually supplied to the blade with the flap beneath the envelope body and away from said placement wall, and a moistener rocker attached by a hinge to said blade;

a lower part attached below said upper part and forming a liquid tank;

a liquid transfer element having a lower portion extending into said lower part and a curved upper portion mounted in said upper part;

a moistening element mounted in said upper part individually from said curved upper portion of said water transfer element and abutting said curved upper portion of said liquid transfer element with a contact surface allowing liquid transfer between said liquid transfer element and said moistening element, said moistener element having a trapezoidally shaped contact surface with said liquid transfer element, having a liquid storage capacity that increases with increasing distance from said placement wall; and said flap of said envelope being manually moved against said moistening element in a transport direction as the envelope is manually supplied to the blade, and said moistener element being mounted in said moistener rocker with a first edge of said moistening element closer to said placement wall than a second edge of said moistening element, said second edge having a larger width in said transport direction than said first edge.

22. A manually operated moistener as claimed in claim 13 wherein said moistening element comprises anti-bacterial material.

23. A manually operated moistener as claimed in claim 14 wherein said moistening element comprises anti-bacterial material.

24. A manually operated moistener as claimed in claim 21 wherein said moistening element comprises anti-bacterial material.

* * * * *